US009799501B2

(12) United States Patent
Toriumi et al.

(10) Patent No.: US 9,799,501 B2
(45) Date of Patent: Oct. 24, 2017

(54) SAMPLE MOUNTING PLATE

(71) Applicants: CITIZEN FINEDEVICE CO., LTD., Minamitsuru-gun, Yamanashi (JP); CITIZEN WATCH CO., LTD., Nishitokyo-shi, Tokyo (JP)

(72) Inventors: Kazuhiro Toriumi, Minamitsuru-gun (JP); Mitsunori Miyamoto, Minamitsuru-gun (JP); Kenji Shimizu, Minamitsuru-gun (JP)

(73) Assignees: CITIZEN FINEDEVICE CO., LTD., Yamanashi (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 14/900,963

(22) PCT Filed: Jul. 24, 2014

(86) PCT No.: PCT/JP2014/069578
§ 371 (c)(1),
(2) Date: Dec. 22, 2015

(87) PCT Pub. No.: WO2015/019861
PCT Pub. Date: Feb. 12, 2015

(65) Prior Publication Data

US 2016/0141166 A1 May 19, 2016

(30) Foreign Application Priority Data

Aug. 7, 2013 (JP) ..... 2013-164618

(51) Int. Cl.
*H01J 49/04* (2006.01)

(52) U.S. Cl.
CPC ..... *H01J 49/0418* (2013.01)

(58) Field of Classification Search
USPC ..... 250/288
See application file for complete search history.

(56) References Cited

U.S. PATENT DOCUMENTS

2002/0055125 A1 5/2002 Charych et al.
2002/0187312 A1* 12/2002 Fonash ..... C23C 16/24 428/195.1

(Continued)

FOREIGN PATENT DOCUMENTS

JP 2003-247983 A 9/2003
JP 2003-536073 A 12/2003

(Continued)

OTHER PUBLICATIONS

Oct. 28, 2014 Search Report issued in International Patent Application No. PCT/JP2014/069578.

(Continued)

*Primary Examiner* — Kiet T Nguyen
(74) *Attorney, Agent, or Firm* — Oliff PLC

(57) ABSTRACT

A sample mounting plate has: a substrate made of alumina ceramic which exhibits white; and a cover layer which is laminated so as to cover the front surface of the substrate and which has multiple grooves formed in some areas. The cover layer has: a conductive interference layer which exhibits conductivity and is configured so as to exhibit a prescribed color (such as navy blue) through light interference and which is laminated on the substrate; and a water-repellent layer which exhibits higher water repellency than that of the substrate and is laminated on at least a part of the conductive interference layer and on which a sample is to be mounted.

11 Claims, 5 Drawing Sheets

(56) References Cited

U.S. PATENT DOCUMENTS

| | | | | |
|---|---|---|---|---|
| 2003/0013130 | A1 | 1/2003 | Charych et al. | |
| 2003/0017508 | A1 | 1/2003 | Charych et al. | |
| 2004/0038423 | A1 | 2/2004 | Smirnov et al. | |
| 2005/0040328 | A1 | 2/2005 | Donegan et al. | |
| 2007/0042442 | A1 | 2/2007 | Charych et al. | |
| 2007/0048806 | A1 | 3/2007 | Charych et al. | |
| 2008/0102536 | A1* | 5/2008 | Toriumi | G01N 23/2258 436/173 |
| 2011/0272575 | A1* | 11/2011 | Kim | B41J 2/04563 250/288 |

FOREIGN PATENT DOCUMENTS

| | | | |
|---|---|---|---|
| JP | 2004-045103 | A | 2/2004 |
| JP | 2005-536743 | A | 12/2005 |
| JP | 2007-502980 | A | 2/2007 |

OTHER PUBLICATIONS

Kawahata Shin'ichiro et al. "MALDI-TOFMS," Journal of the Japan Society of Colour Material, vol. 79, No. 6, pp. 257-262, 2006.

* cited by examiner

FIG.3A

| NAME | | MATERIAL | THICKNESS(nm) |
|---|---|---|---|
| CONDUCTIVE INTERFERENCE LAYER 121 | SECOND TRANSPARENT LAYER 1214 | $SiO_2$ | 90 |
| | SECOND METAL LAYER1213 | Ti | 10 |
| | FIRST TRANSPARENT LAYER 1212 | $Al_2O_3$ | 80 |
| | FIRST METAL LAYER1211 | Ni | 80 |

FIG.3B

| NAME | | MATERIAL | THICKNESS(nm) |
|---|---|---|---|
| CONDUCTIVE INTERFERENCE LAYER 121 | SECOND TRANSPARENT LAYER 1214 | $SiO_2$ | 140 |
| | SECOND METAL LAYER1213 | Ni | 10 |
| | FIRST TRANSPARENT LAYER 1212 | $TiO_2$ | 70 |
| | FIRST METAL LAYER1211 | Al | 100 |

SAMPLE MOUNTING PLATE

TECHNICAL FIELD

The present invention relates to a sample mounting plate that mounts a sample.

BACKGROUND ART

As one of ionization methods in mass spectrometry, Matrix Assisted Laser Desorption/Ionization (MALDI) is known. In the MALDI process, to analyze an analyzing object that is less likely to absorb laser light or an analyzing object that is susceptible to damage by laser light, such as protein, an analyzing object is dispersed in a material that absorbs laser light easily and is ionized easily (matrix) to form a sample, and then the sample (the matrix and the analyzing object) is irradiated with laser light to be ionized.

In a mass spectrometer using the MALDI process, in general, a sample is arranged on a plate made of metal, which is called a sample plate (or a target plate), and the sample arranged on the plate is irradiated with laser light. At this time, a voltage is applied to the plate as needed to accelerate ions generated with irradiation of laser light.

As a conventional art described in a gazette, use of a sample plate in the MALDI process is described, in which the sample plate includes an electrically conductive rectangular stainless steel substrate having a first surface, and the first surface is coated with a hydrophobic coating of a synthetic wax, natural wax, lipid, organic acid, ester, silicon oil, or silica polymers (refer to Patent Document 1).

In addition, as another conventional art described in a gazette, use of a sample plate in the MALDI process is described, in which the sample plate includes an electrically conductive stainless steel substrate having a first surface, and at least a portion of the first surface is coated with a composite coating that includes a hydrophobic coating and a coating of a thin film mixture of a matrix and an intercalating polymer (refer to Patent Document 2).

CITATION LIST

Patent Literature

Patent Document 1: Japanese Unexamined Patent Application Publication (Translation of PCT Application) No. 2005-536743

Patent Document 2: Japanese Unexamined Patent Application Publication (Translation of PCT Application) No. 2007-502980

SUMMARY OF INVENTION

Technical Problem

By the way, in a case where mass spectrometry using the MALDI process is to be carried out, there is a request to apply a voltage to a sample mounted on a sample mounting plate through the sample mounting plate.

Moreover, when mass spectrometry using the MALDI process is to be carried out, there is also a request to easily recognize on which position in the sample mounting plate a sample mounted on the sample mounting plate is arranged.

An object of the present invention is to provide a sample mounting plate capable of applying a voltage to a mounted sample and improving visibility of the mounted sample.

Solution to Problem

A sample mounting plate according to the present invention includes: a substrate that has an insulation property; a conductive interference layer that has conductivity and exhibits a color different from the substrate with optical interference, and is laminated on the substrate; and a water-repellent layer that has water repellency higher than that of the substrate, and is laminated on at least part of the conductive interference layer, wherein a sample to become an object of ionization in mass spectrometry is mounted on at least one of the conductive interference layer and the water-repellent layer.

In the sample mounting plate, it is preferable that the substrate is configured with ceramic on the point that plastic deformation of the sample mounting plate is able to be suppressed.

Moreover, it is preferable that, in the water-repellent layer and the conductive interference layer, a mounting region for mounting the sample is provided with formation of a groove heading from a side on which the sample is mounted toward the substrate side on the point that spread of the sample in the surface direction on the sample mounting plate is able to be suppressed.

Further, it is preferable that the substrate is exposed at a bottom portion of the groove formed in the water-repellent layer and the conductive interference layer on the point that visibility of the mounting region is able to be improved by difference in colors between the mounting region and the bottom portion of the groove, namely, the substrate.

Still further, it is preferable that the conductive interference layer is configured by laminating a metal layer configured with a metal material and a transparent layer configured with a material that is transparent in a visible region on the point that conductivity and optical interference properties are able to be achieved with ease.

Then, it is preferable that the transparent layer is configured with a metal compound on the point that the conductive interference layer is able to be stably configured.

Moreover, from another point of view, a sample mounting plate according to the present invention includes: a substrate that has an insulation property; and a mounting layer that has conductivity and exhibits a color different from the substrate, the mounting layer being laminated on the substrate and on which a sample to become an object of ionization in mass spectrometry is mounted.

In the sample mounting plate, it is preferable that the substrate is configured with ceramic on the point that plastic deformation of the sample mounting plate is able to be suppressed.

Moreover, it is preferable that the mounting layer is configured by laminating a metal layer configured with a metal material and a transparent layer configured with a material that is transparent in a visible region on the point that conductivity and optical interference properties are able to be achieved with ease.

Further, it is preferable that the mounting layer includes a first metal layer as the metal layer laminated on the substrate, a first transparent layer as the transparent layer laminated on the first metal layer, a second metal layer as the metal layer laminated on the first transparent layer and a second transparent layer as the transparent layer laminated on the second metal layer on the point that conductivity and optical interference properties are able to be achieved with ease.

Still further, it is preferable that the transparent layer is configured with an inorganic material on the point that the mounting layer is able to be stably configured.

Then, it is preferable that the mounting layer further includes a water-repellent layer which has water repellency higher than that of the substrate and on which the sample is mounted on the point that spread of the sample in the surface direction on the sample mounting plate is able to be suppressed.

Advantageous Effects of Invention

According to the present invention, it is possible to provide a sample mounting plate capable of applying a voltage to a mounted sample and improving visibility of the mounted sample.

BRIEF DESCRIPTION OF DRAWINGS

FIGS. 3A and 3B are diagrams for illustrating configuration examples of a conductive interference layer in the sample mounting plate;

DESCRIPTION OF EMBODIMENTS

Hereinafter, with reference to attached drawings, an exemplary embodiment according to the present invention will be described in detail.

<Configuration of Sample Mounting Plate>

Figure 1A:
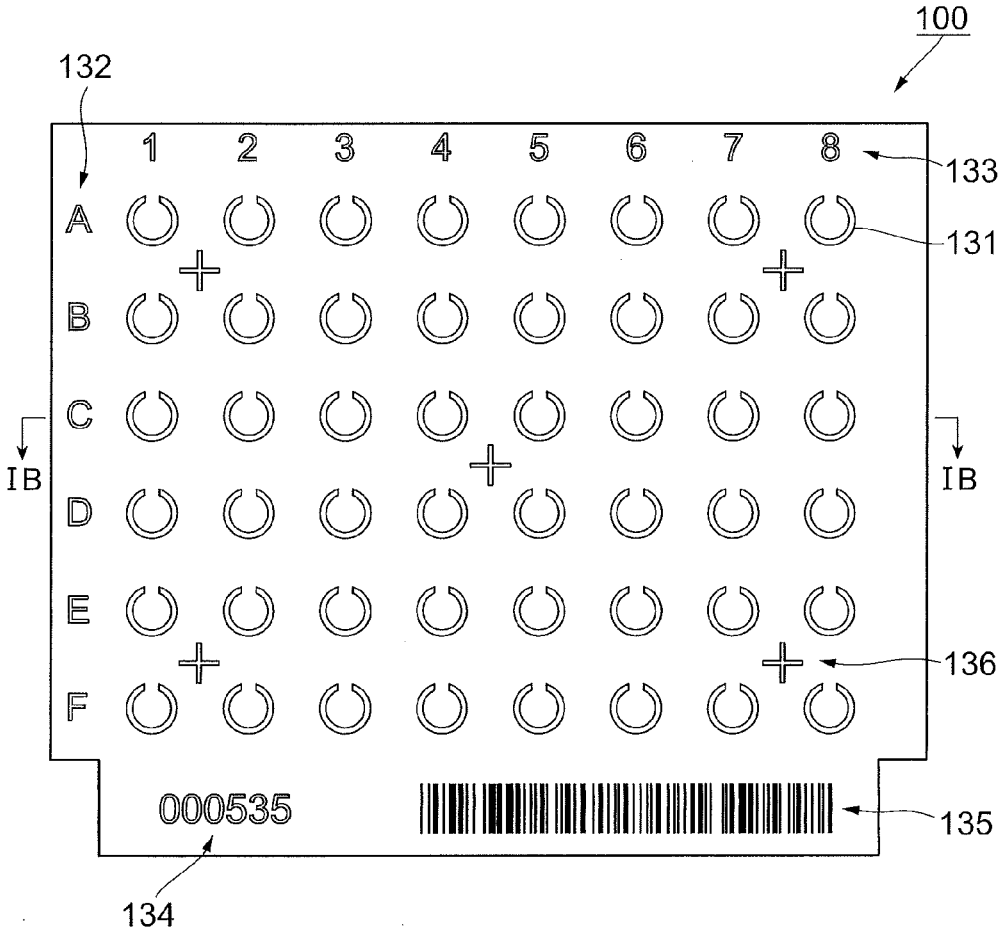
FIGS. 1A and 1B are diagrams showing an overall configuration example of a sample mounting plate to which an exemplary embodiment according to the present invention is applied.
Figure 1B:
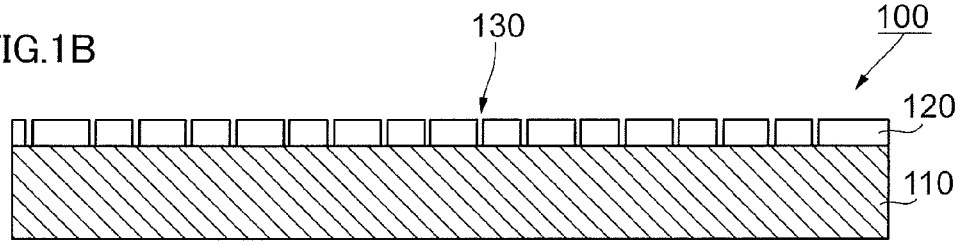

FIGS. 1A and 1B are diagrams showing an overall configuration example of a sample mounting plate 100 to which the exemplary embodiment is applied. Here, FIG. 1A is a top view that views the sample mounting plate 100 from a side on which a sample is mounted, and FIG. 1B is a IB-IB cross-sectional view in FIG. 1A.

The sample mounting plate 100 of the exemplary embodiment is attached to a MALDI-TOFMS (Matrix Assisted Laser Desorption/Ionization-Time of Flight Mass Spectrometry) device 1 (refer to FIG. 5, which will be described later) and used in a state mounting a sample 200 containing an analyzing object (refer to FIGS. 4A to 4C, which will be described later).

The sample mounting plate 100 includes: a substrate 110 formed into a plate-like shape by being provided with a front surface and a back surface; and a cover layer 120 which is laminated to cover the front surface of the substrate 110 and in part of which multiple grooves 130 are formed.

Here, the substrate 110 that constitutes the sample mounting plate 100 includes, as shown in FIG. 1A, a rectangularly punched shape at each of two corners positioned at a lower portion of a landscape-oriented rectangle. If this is viewed from another standpoint, it can be said that the substrate 110 have a shape in which two rectangles, each of which is landscape-oriented, are vertically arranged. Then, in the sample mounting plate 100, the cover layer 120 covers the front surface of the substrate 110 except for portions where the grooves 130 are formed. Note that, in this example, the cover layer 120 or the like is not provided on the back surface of the substrate 110, and therefore, an entire back surface of the substrate 110 is exposed to the outside.

Moreover, as shown in FIG. 1B, at the portions, of the sample mounting plate 100, where the grooves 130 are formed in the cover layer 120, the front surface of the substrate 110 is exposed to the outside. In this example, the width of the groove 130 is from tens of μm to hundreds of μm.

Then, in the sample mounting plate 100 of the exemplary embodiment, on the front surface side of the substrate 110, various kinds of markings as shown in FIG. 1A are provided by the multiple grooves 130 formed in the cover layer 120.

To describe more specifically, first, at the center portion on the front surface side of the sample mounting plate 100, island marks 131, each of which has a C shape, are formed to be arranged into vertically 6 rows and horizontally 8 columns (a total of 48) by the multiple grooves 130. In the sample mounting plate 100 of the exemplary embodiment, the diameter of each island mark 131 is 2 mm, and a space between two island marks 131 adjacent vertically or horizontally is also 2 mm.

Moreover, on the front surface side of the sample mounting plate 100, row address marks 132 that indicate row positions of the respective island marks 131 are formed by the multiple grooves 130 on the left side of the multiple island marks 131 arranged into 6 rows and 8 columns. Note that, in this example, alphabetical characters A to F are assigned to the first row to the sixth row, respectively, as row addresses.

Further, on the surface side of the sample mounting plate 100, column address marks 133 that indicate column positions of the respective island marks 131 are formed by the multiple grooves 130 on the upper side of the multiple island marks 131 arranged into 6 rows and 8 columns. Note that, in this example, Arabic numerals 1 to 8 are assigned to the first column to the eighth column, respectively, as column addresses.

Moreover, on the surface side of the sample mounting plate 100, a serial number 134 (in this example, "000535") assigned to the sample mounting plate 100 is formed by the multiple grooves 130 on the lower left side of the multiple island marks 131 arranged into 6 rows and 8 columns. Further, on the front surface side of the sample mounting plate 100, a bar code 135 including a code imparted to the sample mounting plate 100 is formed by the multiple grooves 130 on the lower right side of the multiple island marks 131 arranged into 6 rows and 8 columns.

Still further, on the front surface side of the sample mounting plate 100, of the multiple island marks 131 arranged into 6 rows and 8 columns, alignment marks 136, each of which has a cross shape and becomes a mark in positioning the sample mounting plate 100 in a later-described MALDI-TOFMS device 1 (refer to FIG. 5), are formed by the multiple grooves 130 at five points, namely, proximities of the four corners and the center portion.

Figure 2:
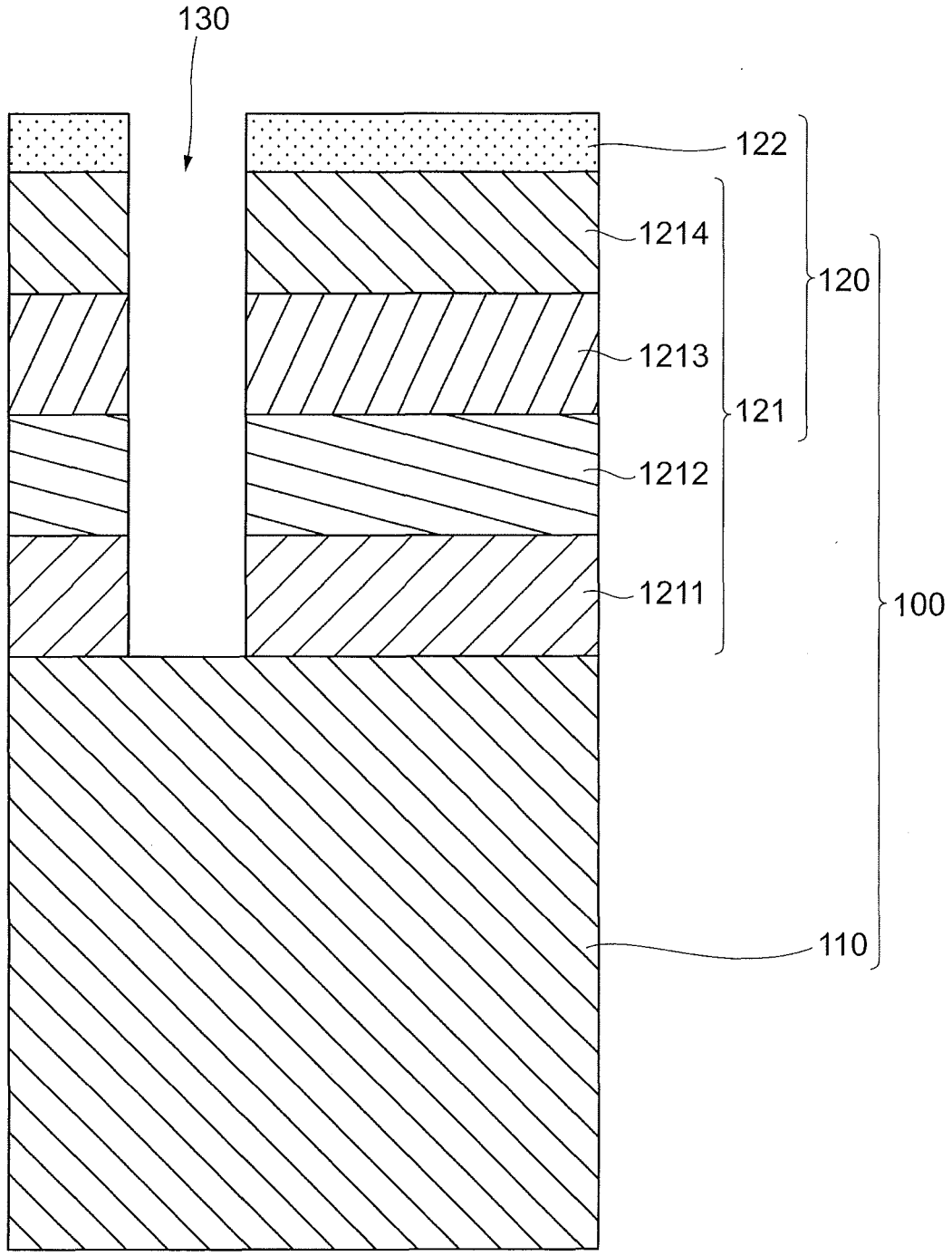
FIG. 2 is a cross-sectional view for illustrating a layer configuration of the sample mounting plate.

FIG. 2 is a cross-sectional view for illustrating a layer configuration of the sample mounting plate 100 shown in FIG. 1B (an enlarged view of the main part of FIG. 1B).

As described above, the sample mounting plate 100 of the exemplary embodiment includes the substrate 110 and the cover layer 120 which is laminated to cover the front surface of the substrate 110 and on part of which the multiple grooves 130 (only one groove 130 is shown in FIG. 2) are formed.

Here, the substrate 110 is configured with a material having insulation properties. Note that, in the exemplary embodiment, the substrate 110 is configured with alumina ceramic of purity of the order of 96%, the thickness thereof is 800 μm, and flatness of the front surface and the back surface thereof is not more than 5 μm. However, in this example, since the substrate 110 is configured with a ceramic material, there are microscopic asperities due to existence of ceramic (alumina) grains and grain boundaries on the front surface and the back surface of the substrate 110. Then, the substrate 110 exhibits white when being irradiated with white light such as sunlight.

Moreover, the cover layer 120 as an example of a mounting layer is configured to have conductivity and to exhibit a predetermined color by optical interference when being irradiated with white light, and includes a conductive interference layer 121 laminated on the substrate 110 and a water-repellent layer 122, which has water repellency (hydrophobic property) higher than that of the substrate 110 and is laminated on at least part of the conductive interference layer 121, and on which the sample 200 (refer to FIGS. 4A to 4C, which will be described later) is mounted.

Then, the conductive interference layer 121 of the exemplary embodiment includes: a first metal layer 1211 which is configured with a metal material having conductivity and laminated on the substrate 110; a first transparent layer 1212 which is configured with a material transparent in a visible region and laminated on the first metal layer 1211; a second metal layer 1213 which is configured with a metal material having conductivity and laminated on the first transparent layer 1212; and a second transparent layer 1214 which is configured with a material transparent in a visible region, laminated on the second metal layer 1213, and further, on which the water-repellent layer 122 is laminated.

Here, the configuration of each of the first metal layer 1211, the first transparent layer 1212, the second metal layer 1213 and the second transparent layer 1214 constituting the conductive interference layer 121 can be appropriately subjected to design change in response to required conductivity and the color to be exhibited. However, it is preferable that the color to be exhibited by the conductive interference layer 121 is a chromatic color (red, orange, yellow, green, blue, indigo blue, purple or the like) with the exception of an achromatic color, such as white, gray or black.

Note that, in the exemplary embodiment, the first metal layer 1211 and the second metal layer 1213 have a function of a metal layer, and the first transparent layer 1212 and the second transparent layer 1214 have a function of a transparent layer or a metal compound layer.

Moreover, the water-repellent layer 122 of the exemplary embodiment is configured with a water-repellent material containing Si (silicon), C (carbon) and F (fluorine). A water contact angle of the water-repellent material constituting the water-repellent layer 122 is 110° and the thickness of the water-repellent layer 122 is the order of 5 nm. Note that, in the exemplary embodiment, the above-described substrate 110 is configured with a material set to have higher hydrophilic property than that of the water-repellent layer 122 (in this example, alumina).

FIGS. 3A and 3B are diagrams for illustrating configuration examples of the above-described conductive interference layer 121. Here, FIG. 3A and FIG. 3B show a first configuration example capable of obtaining the conductive interference layer 121 that exhibits navy blue and a second configuration example capable of obtaining the conductive interference layer 121 that exhibits blue, respectively.

In the first configuration example shown in FIG. 3A, the first metal layer 1211 is composed of Ni (nickel), and the thickness thereof is set to 80 nm. Moreover, the first transparent layer 1212 is composed of $Al_2O_3$ (alumina), and the thickness thereof is set to 80 nm. Further, the second metal layer 1213 is composed of Ti (titanium), and the thickness thereof is set to 10 nm. Still further, the second transparent layer 1214 is composed of $SiO_2$ (silica), and the thickness thereof is set to 90 nm.

On the other hand, in the second configuration example shown in FIG. 3B, the first metal layer 1211 is composed of Al (aluminum), and the thickness thereof is set to 100 nm. Moreover, the first transparent layer 1212 is composed of $TiO_2$ (titania), and the thickness thereof is set to 70 nm. Further, the second metal layer 1213 is composed of Ni (nickel), and the thickness thereof is set to 10 nm. Still further, the second transparent layer 1214 is composed of $SiO_2$ (silica), and the thickness thereof is set to 140 nm.

In the exemplary embodiment, by employing a lamination structure of a metal layer (more specifically, the first metal layer 1211 and the second metal layer 1213) and a transparent layer (more specifically, the first transparent layer 1212 and the second transparent layer 1214) as the conductive interference layer 121, a specific wavelength of light (white light) incident from the outside is reflected by optical interference. Here, a degree of the optical interference (which wavelength light is reflected) is determined depending on mutual relationship between the composing material (a refractive index) and the thickness of each layer constituting the conductive interference layer 121. This causes the conductive interference layer 121 employing the first configuration example shown in FIG. 3A to exhibit navy blue, and causes the conductive interference layer 121 employing the second configuration example shown in FIG. 3B to exhibit blue. Accordingly, by appropriately changing the lamination structure (the composing material (the refractive index) and the thickness) of the conductive interference layer 121, it becomes possible to obtain the conductive interference layer 121 that exhibits a desired color (a chromatic color).

Moreover, in the exemplary embodiment, the sample mounting plate 100 is configured by laminating the cover layer 120 that exhibits a chromatic color (for example, navy blue or blue as described above) on the substrate 110 configured with alumina ceramic that exhibits white, and at the portions where the grooves 130 are formed in the cover layer 120, the substrate 110 is exposed. Therefore, the island marks 131, the row address marks 132, the column address marks 133, the serial number 134, the bar code 135 and the alignment marks 136 (for all of them, refer to FIG. 1A), which are formed on the sample mounting plate 100 by the respective grooves 130, exhibit white, and visibility of each marking is increased by contrast to the cover layer 120 that exhibits a chromatic color.

Here, in both of the first configuration example shown in FIG. 3A and the second configuration example shown in FIG. 3B, the second transparent layer 1214, which is the uppermost layer in the conductive interference layer 121, is composed of $SiO_2$ (silica) by the following reason.

In the sample mounting plate 100 of the exemplary embodiment, as shown in FIG. 2 or the like, the water-repellent layer 122 is formed on the second transparent layer 1214 that constitutes the conductive interference layer 121. In the sample mounting plate 100, to prevent the water-repellent layer 122 from peeling off the conductive interference layer 121, it is necessary to increase adhesiveness between the conductive interference layer 121 and the water-repellent layer 122.

In the exemplary embodiment, as the water-repellent layer 122, the water-repellent material containing Si (silicon) is used as described above. In the exemplary embodiment, as the second transparent layer 1214 of the conductive interference layer 121, on which the water-repellent layer 122 is laminated, $SiO_2$ (silica) containing Si (silicon) as similar to the water-repellent layer 122 is used, and thereby the adhesiveness between the conductive interference layer 121 and the water-repellent layer 122 is increased, to thereby prevent the water-repellent layer 122 from peeling off the sample mounting plate 100.

Note that, in the examples shown in FIGS. 3A and 3B, the first metal layer 1211 and the second metal layer 1213, each constituting the conductive interference layer 121, were configured with different metal materials; however, not limited thereto, the first metal layer 1211 and the second metal layer 1213 may be configured with the same metal material. Moreover, in the examples shown in FIGS. 3A and 3B, each of the first metal layer 1211 and the second metal layer 1213 constituting the conductive interference layer 121 were configured with a single metal (pure metal); however, not limited thereto, any one or both of the first metal layer 1211 and the second metal layer 1213 may be configured with an alloy.

Further, in the examples shown in FIGS. 3A and 3B, the first transparent layer 1212 and the second transparent layer 1214, which constitute the conductive interference layer 121, were configured with different materials; however, the materials are not limited thereto, and the first transparent layer 1212 and the second transparent layer 1214 may be configured with the same material. Still further, in the examples shown in FIGS. 3A and 3B, the first transparent layer 1212 and the second transparent layer 1214, which constitute the conductive interference layer 121, were configured by use of inorganic materials; however, the materials are not limited thereto, and any one or both of them may be configured with an organic material (engineering plastic), such as PE (polyethylene), PP (polypropylene) or PMMA (polymethylmethacrylate). Moreover, in the examples shown in FIGS. 3A and 3B, each of the first transparent layer 1212 and the second transparent layer 1214, which constitute the conductive interference layer 121, was configured with metal oxide; however, the material is not limited thereto, and any one or both of them may be configured with an inorganic material, such as metal nitride or metal fluoride. Then, in the examples shown in FIGS. 3A and 3B, the first transparent layer 1212 and the second transparent layer 1214, which constitute the conductive interference layer 121, were configured with a material having insulation properties; however, the materials are not limited thereto, and any one or both of them may be configured with an inorganic material having conductivity, such as ITO (indium tin oxide).

Figure 4A:
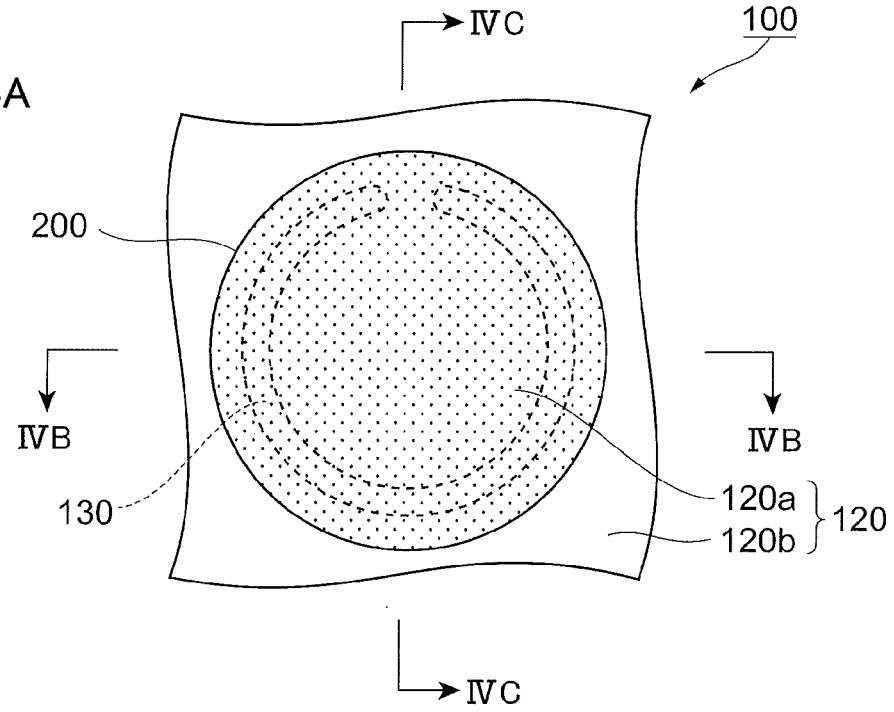
FIGS. 4A to 4C are diagrams for illustrating a configuration around a single island mark in the sample mounting plate.
Figure 4B:
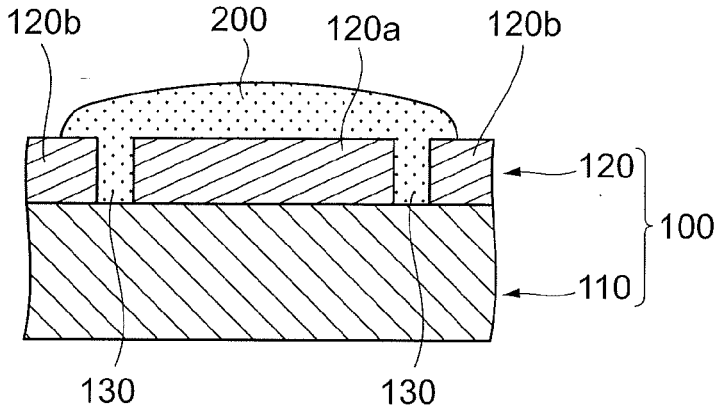
Figure 4C:
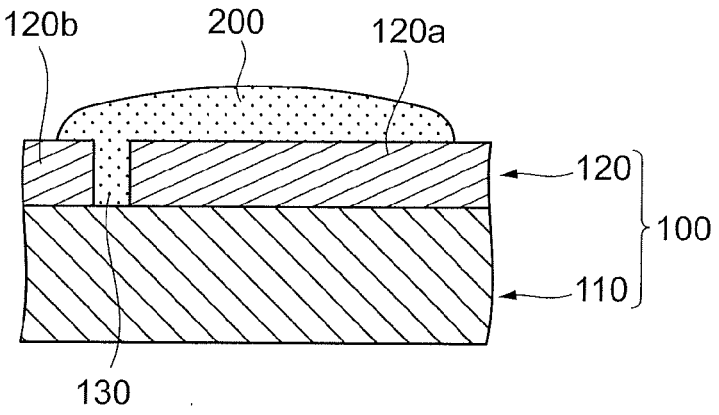

FIGS. 4A to 4C are diagrams for illustrating a configuration around a single island mark 131 in the sample mounting plate 100 shown in FIGS. 1A and 1B. Here, FIG. 4A is a top view in which the sample mounting plate 100 is viewed from a side on which the sample is mounted, FIG. 4B is a IVB-IVB cross-sectional view in FIG. 4A, and FIG. 4C is a IVC-IVC cross-sectional view in FIG. 4A.

Note that, in FIGS. 4A to 4C, the sample 200 mounted on the sample mounting plate 100 is shown together.

In the sample mounting plate 100 of the exemplary embodiment, the cover layer 120 includes island-state portions 120*a* positioned inside the island marks 131 obtained by the grooves 130 formed into the C shape and surrounding portions 120*b* surrounding the island-state portions 120*a* by being positioned outside the island marks 131. However, since the island mark 131 is formed into the C shape in the cover layer 120, the island-state portion 120*a* and the surrounding portion 120*b* are not completely separated, but maintain a state being partially integrated (coupled). Note that, in this example, in the single sample mounting plate 100, there exist the 48 island-state portions 120*a* because the 48 island marks 131 are formed (refer to FIG. 1A). Then, on the sample mounting plate 100, the sample 200 is able to be mounted on each of the 48 island-state portions 120*a* as an example of a mounting region.

<Sample>

Here, the sample 200 to be mounted on the sample mounting plate 100 of the exemplary embodiment will be described.

In the MALDI (Matrix Assisted Laser Desorption/Ionization) process employed by the MALDI-TOFMS device 1, which will be described later (refer to FIG. 5), the analyzing object dispersed into a matrix that uniquely absorbs laser oscillating at a specific wavelength (for example, ultraviolet) and solidified is used as the sample 200. Here, as the analyzing object, examples include a specimen, such as blood, saliva, phlegm or urine taken from a living body, and various kinds of organic compounds.

Moreover, in the MALDI process, examples of matrix used in the case where ultraviolet laser is used include: SA (sinapinic acid); CHCA (α-cyano-4-hydroxycinnamic acid); DHBA (2,5-dihydroxybenzoic acid); and HABA (2-(4-hydroxy phenylazo)benzoic acid).

Note that, here, description was given on the assumption that the sample 200 included the analyzing object and the matrix; however, it is possible to add an ionization agent to the sample 200 as needed.

<Sample Mounting Method onto Sample Mounting Plate>

Subsequently, description will be given of a method of mounting the sample 200 onto the sample mounting plate 100.

Here, first, the sample 200 in the liquid is prepared by mixing a solvent, a matrix and an analyzing object to disperse the analyzing object in the matrix. In preparing the sample 200 in the liquid state, the matrix is excessively supplied to the analyzing object. Here, since the matrix exhibits white, the sample 200 to be obtained also exhibits white.

Note that, in the exemplary embodiment, the 48 island-state portions 120*a* are provided to the single sample mounting plate 100, and it is possible to mount the sample 200 on each of the island-state portions 120*a*. Accordingly, with respect to the single sample mounting plate 100, the samples with different analyzing objects up to 48 types can be mounted.

Next, the sample mounting plate 100 is placed with the cover layer 120 facing upward. Then, the sample 200 in the liquid state is supplied to each of the island-state portions 120*a* in the sample mounting plate 100. At this time, the island-state portion 120*a*, which is a supply destination, is easily distinguished by the island mark 131 (the groove 130) that exhibits white, which is provided corresponding to the island-state portion 120*a* that exhibits a chromatic color. Note that the sample 200 in the liquid state may be supplied to the island-state portion 120*a*, for example, by dropping, or may be supplied to the island-state portion 120*a*, for example, by coating.

The sample 200 in the liquid state supplied to the island-state portion 120*a* tends to spread radially along the surface of the island-state portion 120*a* under the influence of gravity. However, since the sample 200 in the liquid state is supplied to the water-repellent layer 122 positioned at the uppermost part of the island-state portion 120*a*, a force to suppress radial spreading acts on the sample 200 in the liquid state by the water-repellent layer 122. Then, in the case where the force to radially spread the sample 200 in the liquid state overcomes the force to suppress radial spreading, the sample 200 in the liquid state spreads toward the surrounding portion 120*b* from the island-state portion 120*a*.

Here, in the exemplary embodiment, the island mark 131 made of the groove 130 is formed at the portion outside the island-state portion 120*a*, namely, the portion facing the surrounding portion 120*b*. For this reason, the sample 200 heading from the island-state portion 120*a* toward the surrounding portion 120*b* enters into the inside of the groove 130 constituting the island mark 131 before reaching the surrounding portion 120*b*, and arrives at a bottom portion, namely, the portion where the substrate 110 is exposed. At this time, in the exemplary embodiment, since the substrate 110 is composed of alumina having higher hydrophilic property than that of the above-described water-repellent layer 122, the sample 200 that entered into the inside of the groove 130 stays inside the groove 130 in stable condition. As a result, as compared to the case in which the groove 130 constituting the island mark 131 is not provided, it becomes possible to reduce the sample 200 that moves from the island-state portion 120*a* to the surrounding portion 120*b*, and accordingly, it becomes possible to suppress the spread of the sample 200 on the sample mounting plate 100, and to avoid mixing of two samples 200 adjacent on the sample mounting plate 100.

Then, after supply of the required number of samples 200 to the sample mounting plate 100 is completed, each sample 200 mounted on each island-state portion 120*a* in the sample mounting plate 100 is dried and solidified. Each sample 200 solidified on the sample mounting plate 100 continuously exhibits white.

By the above process, mounting (securing) of each sample 200 onto the sample mounting plate 100 is completed.

<Manufacturing Method of Sample Mounting Plate>

Next, a manufacturing method of the sample mounting plate 100 shown in FIGS. 1A and 1B or the like will be described.

(Substrate Forming Process)

First, formation of the substrate 110 is carried out. To describe specifically, the front surface and the back surface of a base material (alumina ceramic) of the substrate 110, which was molded and fired into the form shown in FIGS. 1A and 1B in advance, is polished to obtain the substrate 110 in which the thickness thereof is 800 μm and the flatness thereof is set to not more than 5 μm.

(Cover Layer Forming Process)

Next, on the front surface of the substrate 110 obtained by the above-described substrate forming process, the cover layer 120 including the conductive interference layer 121 and the water-repellent layer 122 is formed. Note that, in this example, the conductive interference layer 121 including the first metal layer 1211, the first transparent layer 1212, the second metal layer 1213 and the second transparent layer 1214, and the water-repellent layer 122 are successively laminated in a single batch process by use of an electron beam vapor deposition device capable of carrying plural vapor deposition sources.

To specifically describe, of the cover layer forming process, in the process of forming the conductive interference layer 121, with respect to the front surface of the substrate 110 arranged in a not-shown chamber, electron beam vapor deposition is carried out for the first metal layer 1211 and the second metal layer 1213 in high vacuum and for the first transparent layer 1212 and the second transparent layer 1214 in oxygen atmosphere with the metal material corresponding to each layer serving as the vapor deposition source, to thereby successively obtain each object layers.

Moreover, of the cover layer forming process, in the process of forming the water-repellent layer 122, onto the exposed surface of the conductive interference layer 121 (in more detail, the second transparent layer 1214), which has been arranged in the not-shown chamber and has already been formed on the front surface of the substrate 110 by the above-described process, electron beam vapor deposition is carried out in high vacuum with a water-repellent material containing Si (silicon), C (carbon) and F (fluoride) contained in steel wool serving as the vapor deposition source. Then, the water-repellent material evaporated from the steel wool adheres onto the second transparent layer 1214, and thereby the objective water-repellent layer 122 is obtained. Note that, in the cover layer forming process, it is possible to heat the substrate 110 as necessary.

By the above process, the cover layer 120 is formed over the entire front surface of the substrate 110.

(Groove Forming Process)

Subsequently, on the cover layer 120 that has been formed on the front surface of the substrate 110 by the above-described cover layer forming process, the grooves 130 are formed by using the second higher harmonic wave (oscillation wavelength: 532 nm) of an Nd-YAG laser (1054 nm) and sequentially moving irradiation position thereof. The power, irradiation time, etc., of the laser is determined so that the cover layer 120 is removed by the applied laser, and accordingly the grooves 130 from which the front surface of the substrate 110 is exposed to the outside are formed at this time.

Then, on the cover layer 120 formed on the front surface of the substrate 110, the plural grooves 130 are sequentially formed by the above-described process. As a result, on the cover layer 120 laminated on the front surface of the substrate 110, the island marks 131, the row address marks 132, the column address marks 133, the serial number 134, the bar code 135 and the alignment marks 136 are provided by the plural grooves 130.

By the above processes, the sample mounting plate 100 shown in FIGS. 1A and 1B or the like is obtained.

<Configuration of MALDI-TOFMS Device>

Figure 5:
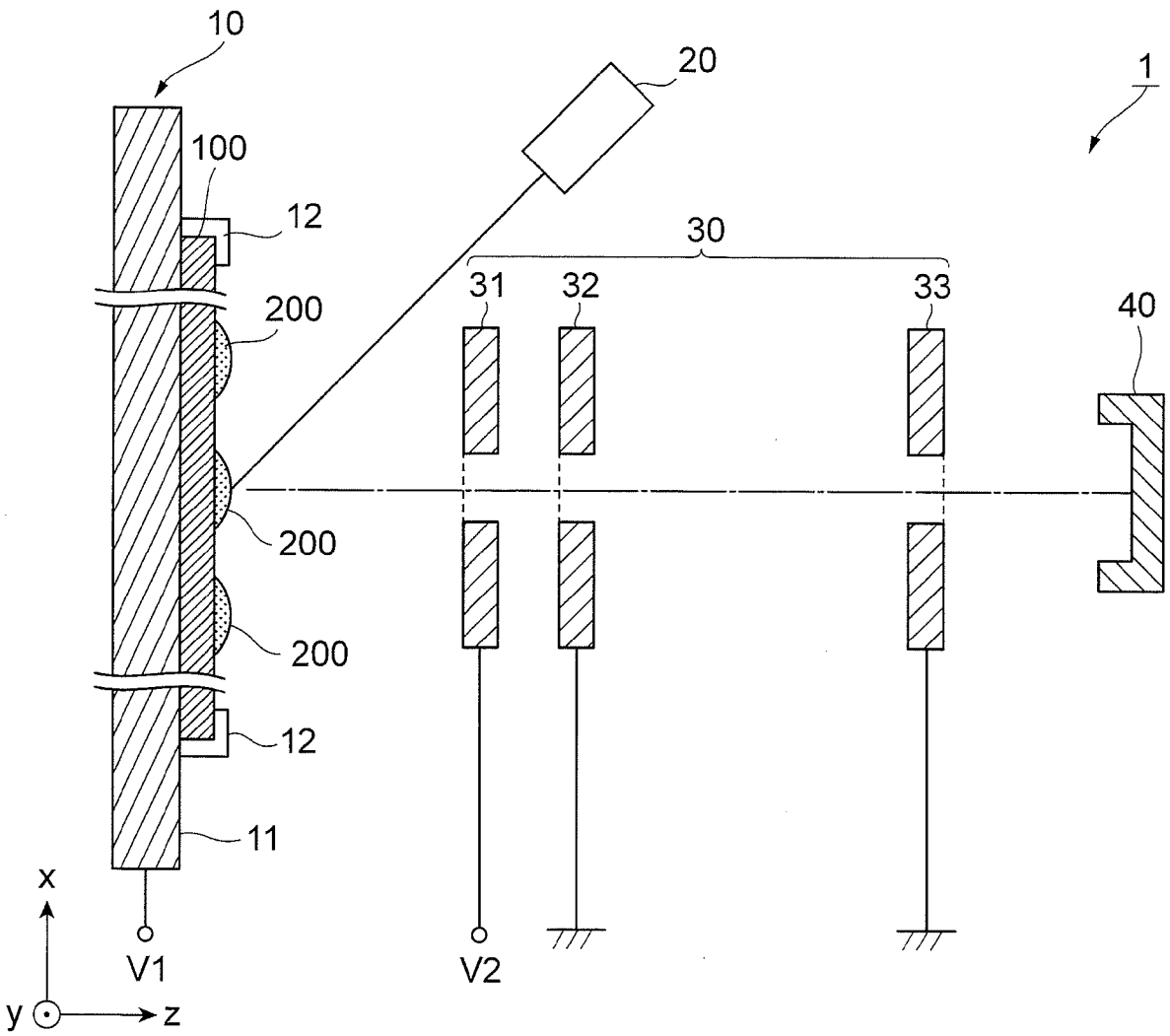
FIG. 5 is a diagram showing a configuration example of a MALDI-TOFMS device.

FIG. 5 is a diagram showing a configuration example of a MALDI-TOFMS device 1.

The MALDI-TOFMS device 1 is a mass spectrometer employing a system that ionizes a sample 200 including an analyzing object by the MALDI (Matrix Assisted Laser Desorption/Ionization) process and temporally separates and detects each ion obtained by ionization of the sample 200 by the TOFMS (Time of Flight Mass Spectrometry) process.

The MALDI-TOFMS device 1 includes: a plate holder 10 that holds the sample mounting plate 100 on which the sample 200 is mounted; a laser light source 20 that irradiates the sample 200 mounted on the sample mounting plate 100 held by the plate holder 10 with laser light; a mass separator 30 that carries out mass separation for each ion by forming a flight space serving as a flight route of each ion, which has been obtained by ionization of the sample 200, and has been desorbed from the sample 200 with laser right irradiation;

and a detector 40 that detects each ion that has been arrived via the flight space in the mass separator 30 on a time-series basis.

Of these, the plate holder 10 includes a movable base portion 11 that carries the sample mounting plate 100 via the back surface side of the substrate 110, and is provided to be movable in the x direction shown in FIG. 5 and in the y direction orthogonal to the x direction, and clamps 12 each of which has a hook-like shape and is attached to the movable base portion 11 for catching and holding the sample mounting plate 100 carried on the movable base portion 11. Here, a free end side of each of the clamps 12 is brought into contact with the mounting surface side of the sample 200 of the sample mounting plate 100, namely, the cover layer 120 (refer to FIGS. 1A and 1B) in the state carrying the sample mounting plate 100 on the movable base portion 11.

In the exemplary embodiment, both of the movable base portion 11 and the clamps 12 constituting the plate holder 10 are configured with a metal material having conductivity. Then, a first voltage V1 is applied to the plate holder 10 via the movable base portion 11 from a not shown power supply. Consequently, the first voltage V1 applied to the movable base portion 11 is also transferred to the cover layer 120 provided to the sample mounting plate 100 via the clamps 12. Moreover, in the exemplary embodiment, the plate holder 10 is able to change the sample 200 existing at a laser irradiation position from the laser light source 20 (a measurement object position) by moving the sample 200 in the x direction and in the y direction via the movable base portion 11.

Next, the laser light source 20 is configured with a nitrogen gas laser (oscillation wavelength: 337 nm), which is a kind of ultraviolet laser operated by pulse oscillation. Note that the oscillation wavelength of the laser light source 20 is variable in response to an absorption wavelength of the matrix constituting the sample 200. Accordingly, depending on the type of the matrix constituting the sample 200, there is a possibility of using another laser, which is different from the nitrogen gas laser.

Further, the mass separator 30 includes: a first grid 31 arranged to face the plate holder 10; a second grid 32 arranged to face the first grid 31; and an end plate 33 arranged to face the second grid 32 and the detector 40. Here, each of the first grid 31, the second grid 32 and the end plate 33 is configured by attaching a metal grid to a metal frame body, and arranged on a downstream side in the z direction (a direction orthogonal to the x direction and the y direction) as viewed from the sample 200 existing at a laser irradiation position from the laser light source 20. A second voltage V2 is applied to the first grid 31 by a not-shown power supply. On the other hand, the second grid 32 and the end plate 33 are grounded.

Still further, the detector 40 faces the end plate 33, and is arranged on a further downstream side of the mass separator 30 in the z direction as viewed from the sample 200 existing at a laser irradiation position from the laser light source 20.

Note that, though not particularly shown in the figure, in the MALDI-TOFMS device 1, the plate holder 10 holding the sample mounting plate 100, the mass separator 30 and the detector 40 are usually arranged inside a chamber which is set to high vacuum, and accordingly, gas particles or the like do not become obstacles to flight in the flight space.

<Mass Spectrometry Operation by MALDI-TOFMS Device>

Mass spectrometry operation by the MALDI-TOFMS device 1 shown in FIG. 5 will be briefly described.

In the state before the mass spectrometry operation is started, the sample mounting plate 100 on which each of the samples 200 is mounted is attached to the plate holder 10. Then, in the state attaching the sample mounting plate 100, the sample 200 to be the analyzing object is arranged at the measurement object position by moving the movable base portion 11 of the plate holder 10 in the x direction and the y direction.

Moreover, in the state before the mass spectrometry operation is started, the first voltage V1 to be applied to the plate holder 10 and the second voltage V2 to be applied to the first grid 31 in the mass separator 30 are set to the same ($\neq 0$).

With the start of the mass spectrometry operation, laser light is emitted toward the sample 200 existing at the measurement object position from the laser light source 20. Then, in the sample 200 irradiated with the laser light, with laser light absorption by the matrix in the sample 200, both of the matrix and the analyzing object constituting the sample 200 are ionized, and start to fly toward the z direction.

At this time, as described above, the voltage of the same magnitude (the first voltage V1=the second voltage V2) is supplied to each of the plate holder 10 that holds the sample mounting plate 100 and the first grid 31 arranged to face the plate holder 10. The first voltage V1 applied to the movable base portion 11 of the plate holder 10 is also supplied to the cover layer 120 provided to the sample mounting plate 100 via the clamps 12. Here, since the first metal layer 1211 and the second metal layer 1213 (refer to FIG. 2) having conductivity are provided to the cover layer 120, the difference in potentials between the cover layer 120 and the first grid 31 facing the cover layer 120 is about 0. As a result, each ion flying from the sample mounting plate 100 provided with the cover layer 120 toward the first grid 31 in the z direction moves without being accelerated by the difference in potential.

Next, the first voltage V1 supplied to the plate holder 10 and the second voltage V2 supplied to the first grid 31 are differentiated. Note that, in the case where the flying ions charge positively, it is assumed that the first voltage V1>the second voltage V2, whereas, in the case where the flying ions charge negatively, it is assumed that the first voltage V1<the second voltage V2. Then, the ions flying between the plate holder 10 (the cover layer 120) and the first grid 31 along the z direction are accelerated by the difference in potentials of the plate holder 10 (the cover layer 120) and the first grid 31, and further pass through the second grid 32 and the end plate 33, to thereby reach the detector 40.

On that occasion, for example, the ions that are of low molecular weight and thus light reach the detector 40 in relatively a short flight time; however, for example, the ions that are of high molecular weight and thus heavy reach the detector 40 in relatively a long flight time. On other words, the time to reach the detector 40 varies depending on the weight of the flying ions (the magnitude of the molecular weight). Then, the detection results by the detector 40 are outputted to a not-shown analyzer (for example, a computer device), and mass spectrometry is carried out on the analyzing object constituting the sample 200 by the analyzer.

In the exemplary embodiment, since the ceramic material having insulation properties is used as the substrate 110 constituting the sample mounting plate 100, it is difficult to apply voltage from the plate holder 10 to the sample 200 mounted on the sample mounting plate 100 via the substrate 110. Therefore, in the exemplary embodiment, the cover layer 120 (more specifically, the conductive interference layer 120), which is formed on the substrate 110 and on which the sample 200 is mounted, is allowed to have conductivity, to thereby make it possible to apply voltage to the sample 200.

Moreover, in the exemplary embodiment, of the cover layer 120 provided to the sample mounting plate 100, the sample 200 is mounted on the island-state portion 120*a*, which is inside of the island mark 131. However, as described above, since the island-state portion 120*a* and the surrounding portion 120*b* are integrated by forming the island mark 131 into the C shape, the first voltage V1 is also applied to the island-state portion 120*a* on which the sample 200 is mounted.

Note that, in the sample mounting plate 100, the first metal layer 1211 and the second metal layer 1213 constituting a conductive layer 121 are not exposed from the surface thereof; however, it is considered that the clamps 12 and at least one of the second metal layer 1213 and the first metal layer 1211 are brought into direct contact by scratches formed in attaching the sample mounting plate 100 to the movable base portion 11 by use of the clamps 12, and thereby conduction between the clamps 12 and at least one of the second metal layer 1213 and the first metal layer 1211 is obtained.

In the exemplary embodiment, since the function of exhibiting the chromatic color and the function of having conductivity were provided to the conductive interference layer 121 of the cover layer 120 provided to the sample mounting plate 100, for example, as compared to the case where the both of the functions are separately provided, it becomes possible to simplify the configuration of the sample mounting plate 100.

Moreover, in the exemplary embodiment, as the substrate 110 in the sample mounting plate 100, not a metal plate, but a plate configured with ceramic was employed. This makes deformation in the sample mounting plate 100 of the exemplary embodiment caused by a bending force or a torsion force less likely to occur. Thus, the sample mounting plate 100 of the exemplary embodiment is able to maintain the flatness of the cover layer 120 formed on the substrate 110 for a long period of time. Moreover, deformation of the sample mounting plate 100 when the sample mounting plate 100 is attached to the plate holder 10 is suppressed.

Note that, in the exemplary embodiment, an alumina ceramic was used as the substrate 110; however, the material is not limited thereto, and other insulation ceramics or insulation materials other than the ceramics may be used.

Moreover, in the exemplary embodiment, each layer constituting the cover layer 120 was formed by use of the electron beam vapor deposition method; however, not limited thereto, any other deposition method may be used.

Further, in the exemplary embodiment, the grooves 130 were formed on the sample mounting plate 100 by use of the laser processing method; however, not limited thereto, formation may be carried out by use of any other method.

REFERENCE SIGNS LIST

1 MALDI-TOFMS device
10 Plate holder
20 Laser light source
30 Mass separator
40 Detector
100 Sample mounting plate
110 Substrate
120 Cover layer
120*a* Island-state portion
120*b* Surrounding portion
121 Conductive interference layer
122 Water-repellent layer
130 Groove
131 Island mark
132 Row address mark
133 Column address mark
134 Serial number
135 Bar code
136 Alignment mark
200 Sample
1211 First metal layer
1212 First transparent layer
1213 Second metal layer
1214 Second transparent layer

The invention claimed is:

1. A sample mounting plate comprising:
a substrate that has an insulation property;
a conductive interference layer that has conductivity and exhibits a color different from the substrate with optical interference, and is laminated on the substrate; and
a water-repellent layer that has water repellency higher than water repellency of the substrate, and is laminated on at least part of the conductive interference layer,
wherein a sample to become an object of ionization in mass spectrometry is mounted on at least one of the conductive interference layer and the water-repellent layer.

2. The sample mounting plate according to claim 1, wherein the substrate is configured with ceramic.

3. The sample mounting plate according to claim 1, wherein, in the water-repellent layer and the conductive interference layer, a mounting region for mounting the sample is provided with formation of a groove heading from a side on which the sample is mounted toward the substrate side.

4. The sample mounting plate according to claim 3, wherein the substrate is exposed at a bottom portion of the groove formed in the water-repellent layer and the conductive interference layer.

5. The sample mounting plate according to claim 1, wherein the conductive interference layer is configured by laminating a metal layer configured with a metal material and a transparent layer configured with a material that is transparent in a visible region.

6. The sample mounting plate according to claim 5, wherein the transparent layer is configured with a metal compound.

7. A sample mounting plate comprising:
a substrate that has an insulation property; and
a mounting layer that has conductivity and exhibits a color different from the substrate, the mounting layer being laminated on the substrate and on which a sample to become an object of ionization in mass spectrometry is mounted,
wherein the mounting layer is configured by laminating a metal layer configured with a metal material and a transparent layer configured with a material that is transparent in a visible region.

8. The sample mounting layer according to claim 7, wherein the substrate is configured with ceramic.

9. The sample mounting layer according to claim 7, wherein the mounting layer includes a first metal layer as the metal layer laminated on the substrate, a first transparent layer as the transparent layer laminated on the first metal layer, a second metal layer as the metal layer laminated on the first transparent layer and a second transparent layer as the transparent layer laminated on the second metal layer.

10. The sample mounting layer according to claim 7, wherein the transparent layer is configured with an inorganic material.

11. A sample mounting plate comprising:

a substrate that has an insulation property; and a mounting layer that has conductivity and exhibits a color different from the substrate, the mounting layer being laminated on the substrate and on which a sample to become an object of ionization in mass spectrometry is mounted, wherein the mounting layer further includes a water-repellent layer which has water repellency higher than water repellency of the substrate, and on which the sample is mounted.

* * * * *